US005085428A

United States Patent [19]

Fermaglich et al.

[11] Patent Number: 5,085,428

[45] Date of Patent: Feb. 4, 1992

[54] BABY WALKER

[76] Inventors: Daniel R. Fermaglich; Lois F. Fermaglich, both of 9 Van Duyne Road, Mountain Lakes, N.J. 07046

[21] Appl. No.: 528,724

[22] Filed: May 24, 1990

[51] Int. Cl.[5] ..... H63B 23/06

[52] U.S. Cl. ..... 272/70; 272/70.3

[58] Field of Search ..... 297/137, 138, 139, 274, 297/275, 276, 349, 135; 108/50, 94; 272/70.3, 114, 70

[56] References Cited

U.S. PATENT DOCUMENTS

| | | | |
|---|---|---|---|
| 839,681 | 12/1906 | Voight . | |
| 875,377 | 12/1907 | Pilia et al. . | |
| 2,198,813 | 4/1940 | Hall . | |
| 2,665,742 | 1/1954 | Starysky . | |
| 2,697,478 | 5/1954 | McKinney . | |
| 2,910,111 | 12/1957 | Hansburg . | |
| 3,127,170 | 10/1962 | Caster | 297/135 |
| 3,130,814 | 4/1964 | Del Aquila . | |
| 3,279,567 | 10/1966 | Kempel . | |
| 3,454,272 | 7/1969 | Elkington . | |
| 3,747,596 | 7/1973 | Mills . | |
| 4,204,673 | 5/1980 | Speer . | |
| 4,334,695 | 6/1982 | Ashby . | |
| 4,743,008 | 5/1988 | Fermaglich | 272/69 |

FOREIGN PATENT DOCUMENTS

| | | |
|---|---|---|
| 734490 | 8/1932 | France . |

*Primary Examiner*—Richard J. Apley
*Assistant Examiner*—J. Donnelly
*Attorney, Agent, or Firm*—Ralph W. Selitto, Jr.

[57] ABSTRACT

An infant walker adapted for use in a substantially stationary location has a frame in the form of a circular tray and an infant seat attached to the frame such that it can be revolved around the frame in an orbital manner. The seat can also rotate about its own axis of rotation, whereby an infant who is in the seat can walk around the tray, turn in place and use the tray as an eating or play/activity center.

10 Claims, 6 Drawing Sheets

BABY WALKER

FIELD OF THE INVENTION

The present invention relates, in general, to an infant walker, and more particularly, to an improved infant walker which permits an infant to exercise its legs while the walker remains stationary, and which also functions as a feeder and/or activity center.

BACKGROUND OF THE INVENTION

Devices which allow an infant to exercise its legs and practice walking have been proposed in the past. For instance, our U.S. Pat. No. 4,743,008 discloses an infant exerciser which is horizontally supported by legs in a stationary position. A rotatable seat is mounted in a central opening of an annular tray and a treadmill assembly is suspended from the seat. An infant placed in the seat is thus able to move its legs in a walking motion on the treadmill and is able to change its field of view.

U.S. Pat. No. 839,681 discloses a baby walker in which a seat is slidably mounted on guide rails supported on a stationary frame. A baby seated in the seat can walk from one end of the guide rails to an opposite end on a fastboard or treadway. Such a device, however, is adapted for unidirectional travel only. That is, once the baby reaches the end of the treadway, the seat must be returned to the other end, thereby requiring assistance from older children or adults. Also, the baby cannot turn around or change its field of view while seated.

U.S. Pat. No. 875,377 discloses a baby walker in which a seat is rotatably mounted on a carriage adapted to move back and forth along a pair of support rods. A baby seated in the seat can walk from one of the support rods to the other end on a platform. Once the baby reaches the opposite end of the platform, he or she can turn the seat around and then walk back to the other end. Because the baby actually walks in a rectilinear fashion along the platform, the baby walker is, out of necessity, comparatively large and cumbersome. Although the mobility of the baby walker is enhanced by trucks (i.e., roller assemblies) provided at the bottom of the walker, such mobility poses a potential hazard in that the walker can be accidentally or unintentionally moved close to stairs or dangerous appliances, such as stoves and heaters.

SUMMARY OF THE INVENTION

In accordance with the present invention, a new and improved infant walker has at least one seat which is revolvably mounted on a stationary frame. More particularly, the seat is sized and shaped so as to permit an infant to sit thereon or to stand therein with its feet on the floor below. The seat is mounted in a rotational assembly (i.e., such that the seat can be spun about) which is connected to the frame by a revolving mounting assembly (i.e., such that the seat can move in a circular path about the axis of the stationary frame). Thus, an infant placed in the seat can practice walking by changing its physical location, simultaneously changing its field of view to orient itself to and interact with the surrounding environment, and yet be denied the mobility of the walker to encounter the potentially hazardous situations discussed hereinabove.

In one embodiment, the frame is in the form of a circular tray having the mounting assembly suspended from a centrally located support bracket and an endless caster track, both of which are attached to the underside of the tray. The tray is immovably maintained above a support surface, such as a floor, by a plurality of legs depending downwardly from the tray. Anti-skid means on the legs inhibit the tray from moving relative to the support surface. By rendering it substantially immobile, the stationary walker is safer than the mobile baby walkers disclosed in the prior art, which, due to their mobility, can be hazardous for the reasons discussed above.

An outer circular ridge is provided on the tray and is positioned such that it can be gripped by the infant to facilitate him or her in rotating the seat or walking around the periphery of the tray. Additionally, independent lock mechanisms can be incorporated into the mounting assembly and the rotational assembly so that the seat can be moved only in a selected direction. That is, the seat will only rotate around the tray, or the seat will only rotate itself (i.e., spin). Moreover, the lock mechanisms can immobilize the seat facing the tray, thereby creating a center for feeding or play.

In another embodiment, the infant walker has two seats: one seat positioned at the periphery of an annular tray having a centrally located opening, and the second seat positioned in the opening of the tray. Both seats are suspended in rotational assemblies on a mounting assembly in a manner similar to that of the seat employed by the first embodiment. A baby placed in the inner seat still has rotational mobility but has no lateral mobility (i.e., it is unable to actually move away from that location). In this embodiment, two infants may exercise simultaneously, one infant in the outer seat and a second infant in the inner seat. The infant in the outer seat can walk a circular path and rotate any direction in that path. Further, the infant in the center seat can rotate the seat with his or her legs and/or hands. The walker may be arranged such that the seats move independently of one another, and, if desired, either of the seats can be locked as described above. Alternatively, the seats may move conjointly. That is, the inner seat will rotate as the outer seat revolves around the frame, or vice versa. Thus, in a situation where one infant is old enough to practice walking and a second infant is younger, then the movements of the older infant in either seat can move the seat in which the younger infant is placed. In view of the above embodiment, the infant walker can thus function as a feeding seat and/or an activity and exercise center for one infant or a pair of infants.

BRIEF DESCRIPTION OF THE DRAWINGS

For a more complete understanding of the present invention, reference may be had to the following detailed description considered in conjunction with the accompanying drawings, in which.

DETAILED DESCRIPTION OF THE EXEMPLARY EMBODIMENTS

Figure 1:
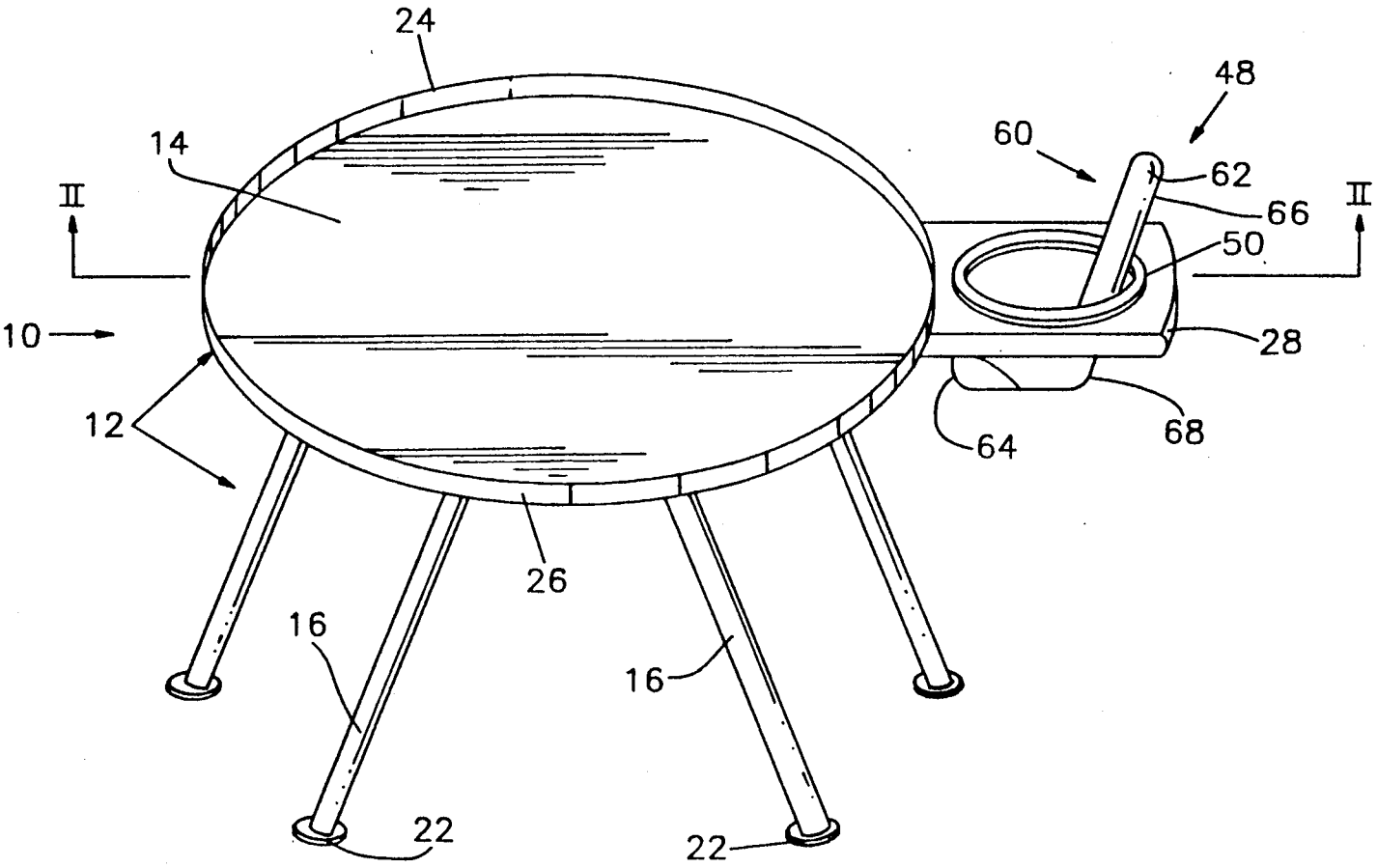
FIG. 1 is a perspective view of an improved infant walker constructed in accordance with one exemplary embodiment of the present invention.
Figure 2:
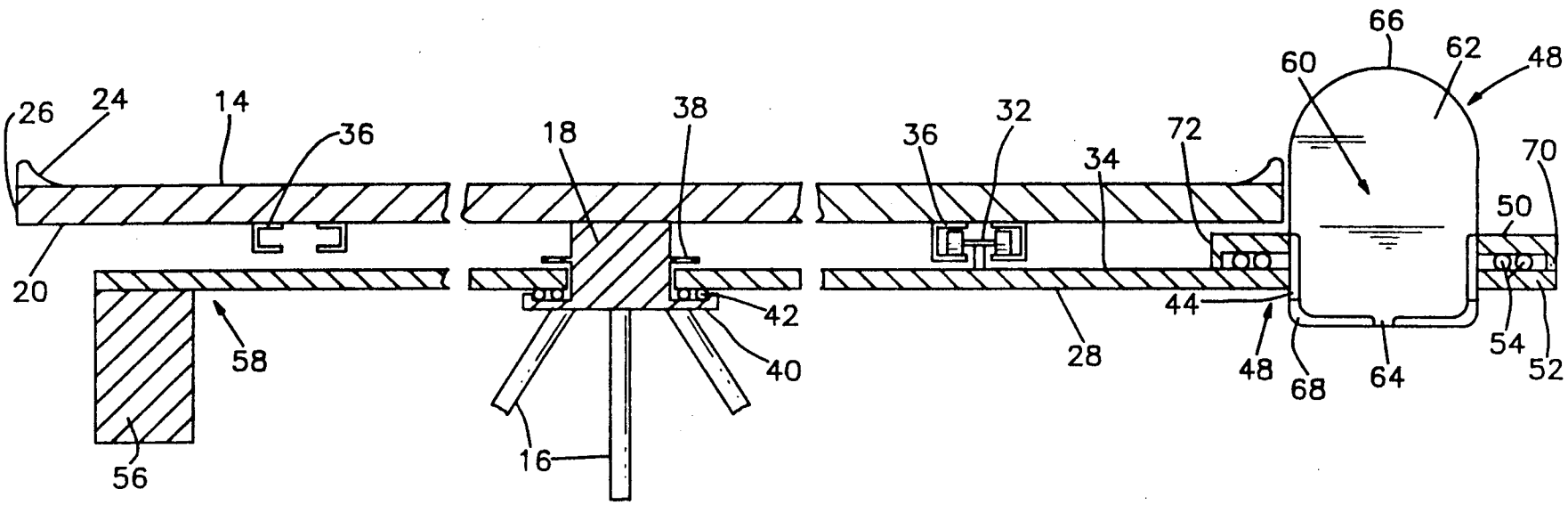
FIG. 2 is a partial cross-sectional view, taken along line II—II of FIG. 1 and looking in the direction of the arrows, of the improved infant walker illustrated in FIG. 1.
Figure 3:
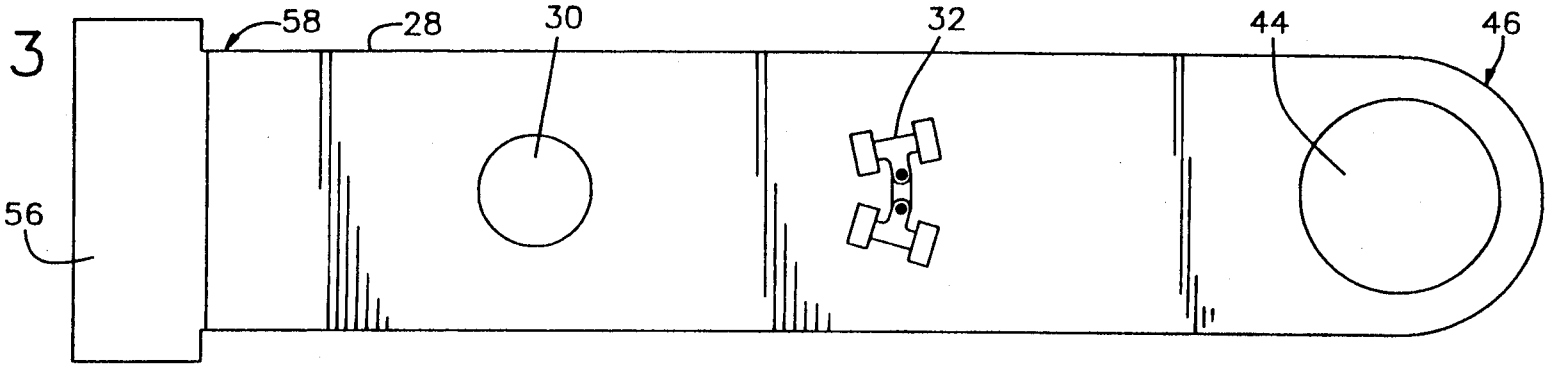
FIG. 3 is a top plan view showing, in detail, a portion of a mounting assembly employed by the infant walker illustrated in FIGS. 1 and 2.

Referring to FIGS. 1, 2 and 3, an infant walker 10 has a frame 12 including a circular tray 14 supported on a plurality of legs 16 in a substantially horizontal and stationary orientation relative to a floor or other support surface. The legs 16 depend from a cylindrical support bracket 18 attached to a bottom surface 20 of the tray 14, each leg 16 being equipped with non-skid pads 22 or feet in order to inhibit the accidental or inadvertent movement of the frame 12 across the floor or other support surface. The height of the legs 16 is adjustable by conventional adjusting means, such as having a telescoping arrangement, so that the walker 10 may be lowered or raised as may be appropriate to allow the feet of the infant seated therein to touch the floor. Additionally, the legs 16 may be releasably fastened to the support bracket 18 by conventional fastening means (not shown) to allow for simple and rapid assembly and disassembly, thereby facilitating storage and transportation of the walker 10.

The tray 14 has an outer circumferential ridge 24, which extends upwardly from an outer circumferential edge 26 of the tray 14 for a purpose to be described hereinafter. Such items as infant toys, food and books can be placed on the tray 14.

A mounting arm 28 is provided having a length which exceeds the diameter of the circular tray 14. The mounting arm 28 is revolvably mounted to the bottom surface 20 of the tray 14 such that the mounting arm 28 can be revolved 360 degrees about the frame 12. More particularly, the mounting arm 28 has a median opening 30, which is sized to just slide over and around the support bracket 18. A caster assembly 32 is attached to an upper surface 34 of the mounting arm 28. A caster track 36 is attached to the bottom surface 20 of the tray 14 near the outer edge 26 of the tray 14. The mounting arm 28 is held in a revolving manner on the support bracket 18 between an upper flange 38, which is attached to the support bracket 18 above the mounting arm 28, and a lower flange 40. Two concentric rows of ball bearings 42, alternatively casters, are housed between the upper flange 38 and the lower flange 40.

A seat opening 44 is provided at a first end 46 of the mounting arm 28 (see FIG. 3), the seat opening 44 being sufficiently large to accommodate an infant seat assembly 48 (see FIGS. 1 and 2). An annular collar 50 extends around the seat opening 44 and is attached to the seat assembly 48, the collar 50 thereby enabling the seat assembly 48 to be suspended in the seat opening 44. The collar 50 rests on an annular roller bearing race 52, both of which have an inner diameter about as large as that of the seat opening 44. The bearing race 52 includes two concentric rows of ball bearings 54, alternatively casters, in an annular caster track, and the collar 52 engages a lock mechanism (not shown) for a purpose to be described hereinafter.

A counterweight 56 is provided at a second end 58 of the mounting arm 28. The counterweight 56 helps to ensure that an infant placed in the seat assembly 48 will not tip the walker 10 over.

Referring to FIGS. 1 and 2, the seat assembly 48 includes an infant seat 60 which is attached at predetermined positions on its outside to the collar 50, which surrounds the seat 60. The seat 60 itself includes a substantially rigid backrest 62 adapted to support the back of an infant and a flexible strap 64 adapted to support the infant's buttocks and crotch while permitting the infant's legs to straddle the strap 64 on opposite sides thereof. More particularly, the back side 66 of the backrest 62 is connected to the collar 50, while the strap 64 extends from a lower end 68 of the backrest 62 to attach to the collar 50 at a point diametrically opposite to the point where the backrest 62 is attached to the collar 50. A flange 70 extends downwardly from the outer edge 72 of the collar and has an outer curvature which matches that of the roller bearing race 52. The flange 70 helps maintain the position of the ball bearings 54 in the race 52. The locking mechanism (not shown) might, for example, be of the racheting variety adapted to engage teeth (not shown) formed on the flange 70. Such a ratchet lock could also be designed to selectively permit rotation of the seat 60 in one direction only.

In use, an infant is placed in the seat 60 after the height of the legs 16 is adjusted to permit the infant's feet to contact the floor or other support surface. The infant is then free to exercise or walk around the frame 12, which remains stationary because the legs 16 immovably engage the floor or other support surface. As the infant otherwise walks or exercises, he or she can grip the outer ridge 24 of the tray 14 and rotate (i.e., spin) the seat 60 relative to the mounting arm 28 in a complete circle (i.e., a full 360 degrees), thereby permitting the infant to better interact with its surrounding environment and to associate the walking movements with changing its location.

Two alternate embodiments of improved infant walkers constructed in accordance with the present invention are illustrated in FIGS. 4–5 and 6–9. Elements illustrated in FIGS. 4–5 and 6–9 which correspond to the elements described above with respect to FIGS. 1, 2 and 3 have been designated by corresponding reference numerals increased by 100 and 200, respectively. New elements illustrated in FIGS. 4–5 and 6–9 which have no counterparts in FIGS. 1, 2 and 3 are designated with odd reference numerals. The embodiments of FIGS. 4–5 and 6–9 operate and are constructed in the same manner as the embodiment of FIGS. 1, 2 and 3 unless it is otherwise stated.

Figure 5:
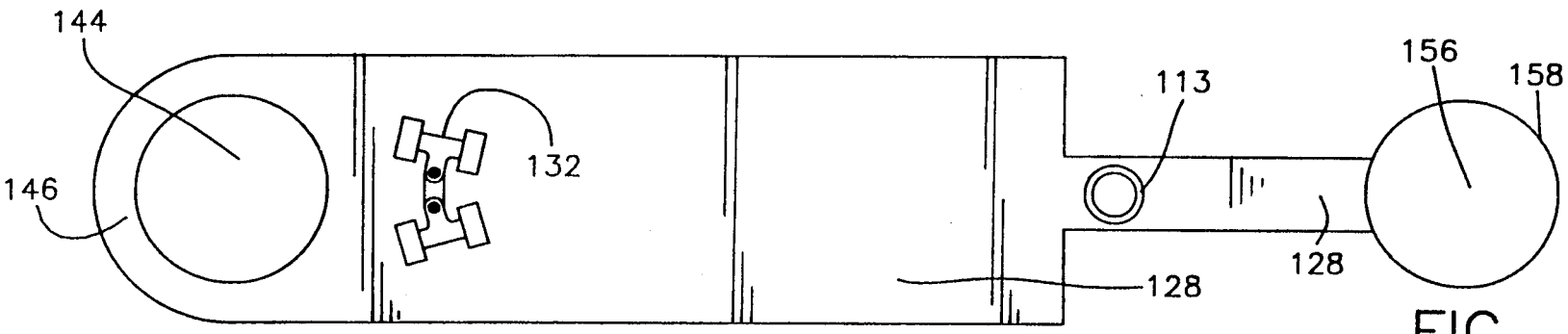
FIG. 5 is a top plan view showing, in detail, a portion of a mounting assembly employed by the infant walker illustrated in FIG. 4.
Figure 9:
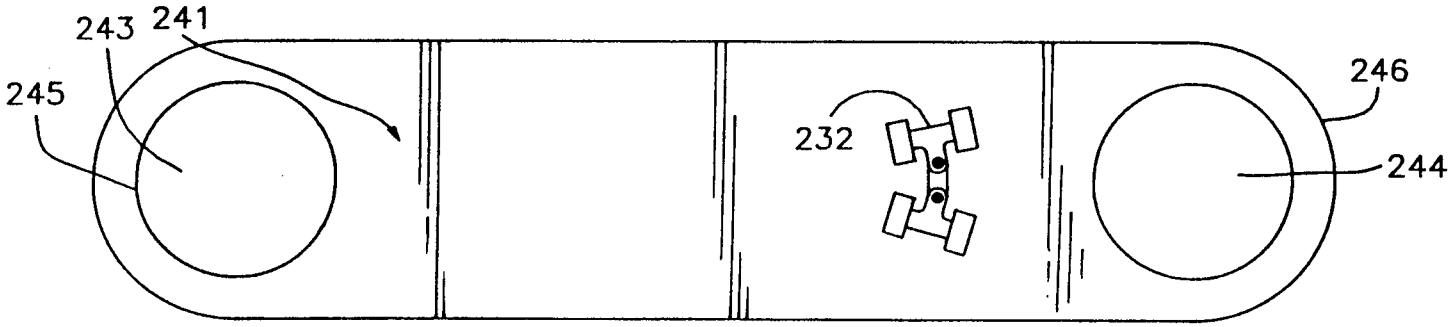
FIG. 9 is a top plan view showing, in detail, a mounting assembly which forms a part of the infant walker illustrated in FIG. 6.
Figure 4:
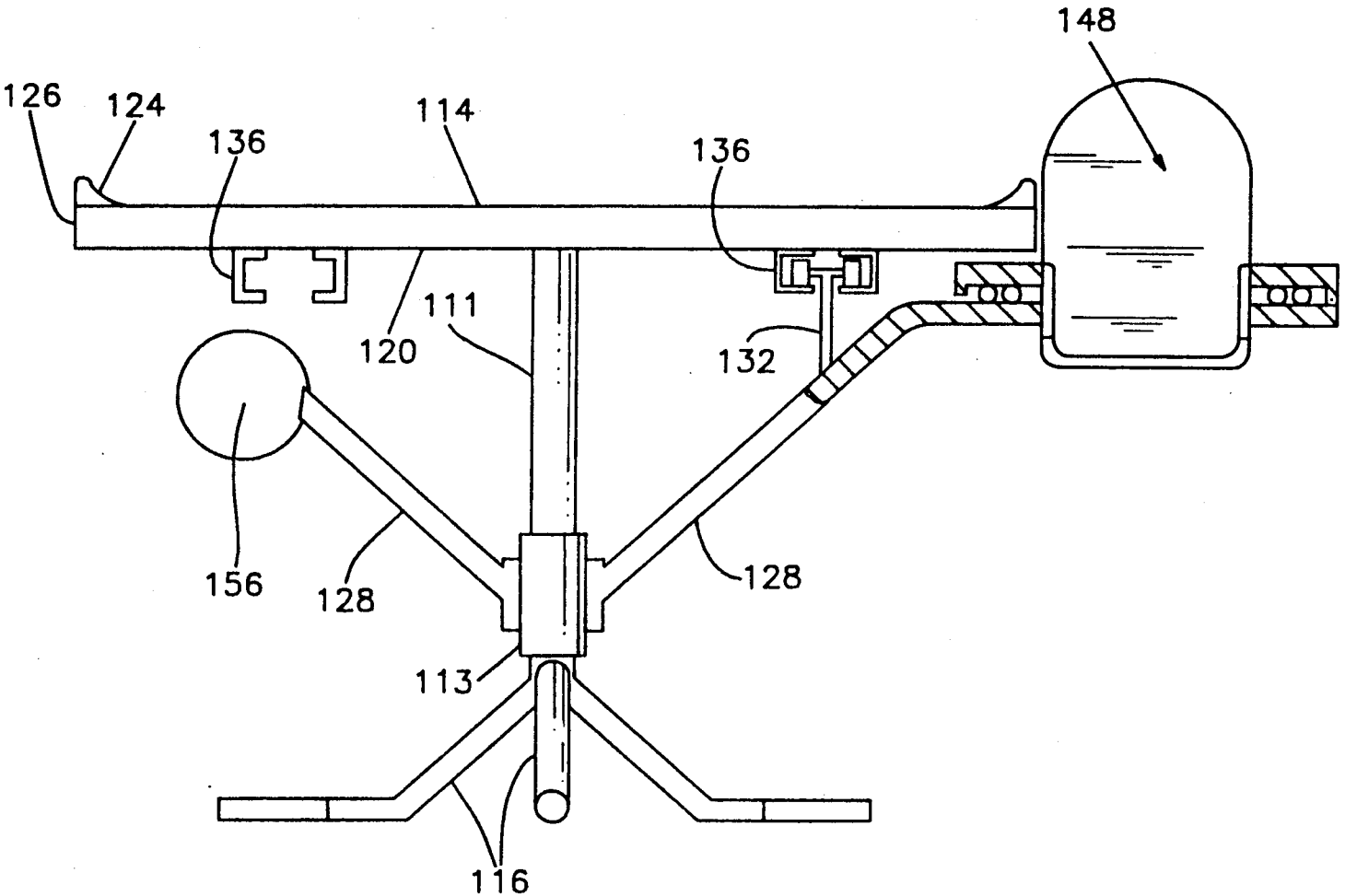
FIG. 4 is an elevational view of an improved infant walker constructed in accordance with another exemplary embodiment of the present invention, a portion of the infant walker being shown in cross section to facilitate consideration and discussion.
Figure 6:
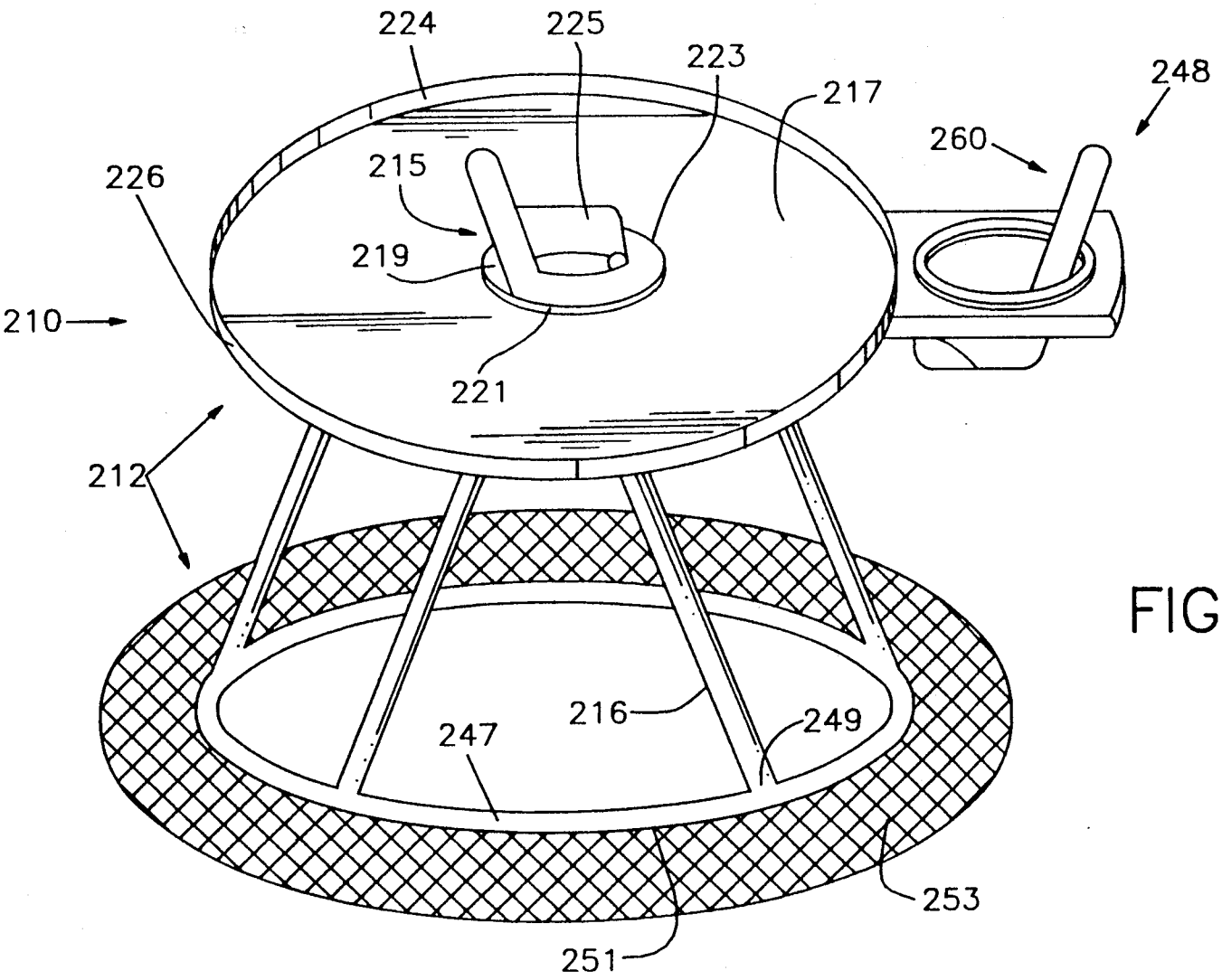
FIG. 6 is a perspective view of an improved infant walker constructed in accordance with another exemplary embodiment of the present invention.
Figure 7:
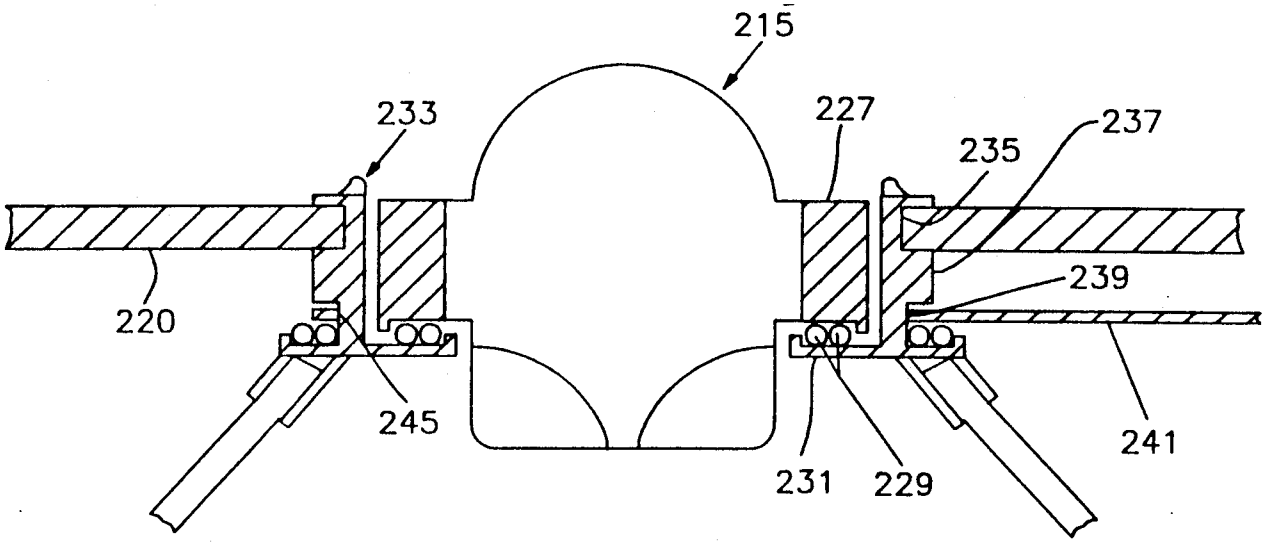
FIG. 7 is a cross-sectional view showing, in detail, a central rotating seat assembly which forms a part of the infant walker illustrated in FIG. 6.
Figure 8:
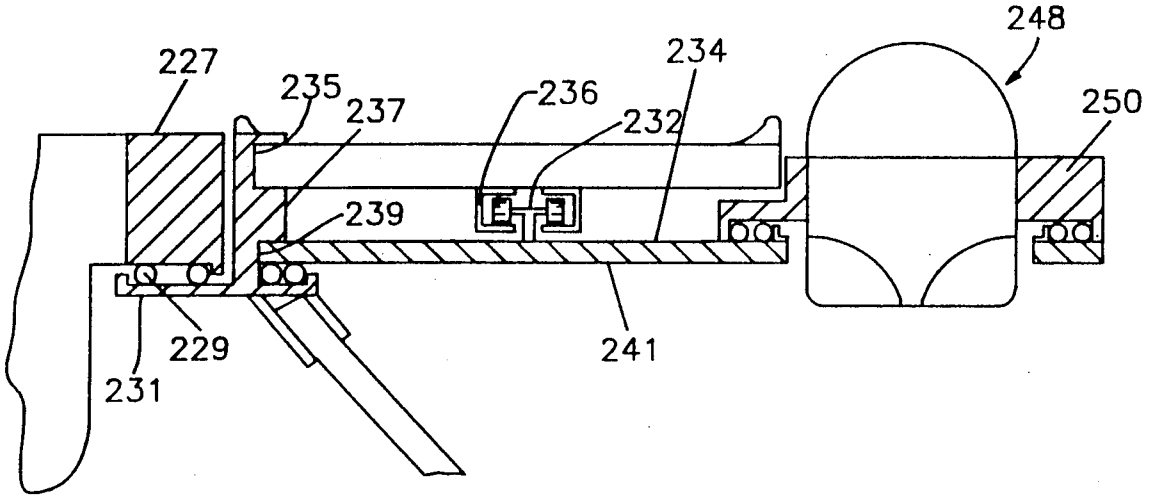
FIG. 8 is a cross-sectional view showing, in detail, a peripheral rotating seat assembly which forms a part of the infant walker illustrated in FIG. 6.

Referring now to FIGS. 4 and 5, a second embodiment of an improved infant exerciser 110 has an adjustable vertical support rod 111 which extends nearly the full height of the frame and terminates in legs 116, alternatively a support base, attached to a lower end thereof. A mounting arm 128 has a sleeve 113 which is received over and around the support rod 111. A first end 146 of the mounting arm 128 has a seat opening 144, which receives a seat assembly 148, while a second end 158 of the mounting arm 128 has a counterweight 156 attached thereto. A caster assembly 132 is positioned between the sleeve 113 and the seat opening 14 proximate to an outer edge 126 of the tray 114 and is received in an annular caster track 136 to move freely therein and to provide additional support for the first end 146 of the mounting arm 128. The operation of this embodiment of the present invention is in all respects similar to that of the embodiment described hereinabove.

With reference to FIGS. 6–9, an improved infant walker 210 includes a central seat assembly 215 as well as a peripheral seat assembly 248. A frame 212 comprises an annular tray 217 having a central opening 219 therein. The tray 217 has an inner circular ridge 221 which extends upwardly from an inner circumferential edge 223 of the tray 217 for a purpose to be described hereinafter. An outer ridge 224 extends upwardly from an outer edge 226 of the tray 217 for a purpose to be described hereinafter. An annular caster track 236 is attached to a bottom surface 220 of the tray 217 near the outer edge 226 thereof.

The central rotating seat assembly 215 includes a seat 225 attached to an annular collar 227, which rests and rolls on two concentric rows of ball bearings 229, alternatively casters, housed in an annular roller bearing race 231, alternatively an annular caster track, set in an annular support ring 233. The support ring 233 is mounted and secured in the central opening 219 by an upper annular slot 235 on its outside surface 237, the slot 235 receiving the inner edge 223 of the tray 217. The support ring 233 extends downwardly below the bottom surface 220 of the tray 217 and has a lower annular slot 239 on its outer surface 237 below the bottom surface 220 of the tray 217 for a purpose to be described hereinafter.

Legs 216 depend from the support ring 233 so as to maintain the tray 217 in a substantially horizontal orientation above a floor or other support surface. The height of the legs 216 is adjustable by conventional adjusting means, such as telescoping means, so that the walker 210 may be lowered or raised as may be appropriate to allow the feet of the infant seated therein to touch the floor. Additionally, the legs 216 may be releasably fastened to the support ring 233 by conventional fastening means (not shown) to allow for simple and rapid assembly and disassembly, thereby facilitating storage and transportation of the walker 210.

A mounting arm 241 has an inner seat opening 243 and an outer seat opening 244. The diameter of the inner opening 243 corresponds to the outer diameter of the lower annular slot 239 in the support ring 233, the slot 239 slidably receiving the edge 245 of the inner seat opening 243. A caster assembly 232 is positioned on the upper surface 234 of the mounting arm 241 to correspond with the annular caster track 236. The inner seat opening 243 and the outer seat opening 244 are sized to receive a central seat assembly 215 and a peripheral seat assembly 248, respectively.

In use, the height of the legs 216 is adjusted to permit the infant's feet to contact the floor or other support surface. If it is desired, an infant may be placed in the peripheral rotating seat assembly 248 thereby allowing him or her to exercise or walk freely around the frame 212, which remains stationary because the legs 216 immovably engage the floor or other support surface. As the infant otherwise walks or exercises, he or she can grip the outer ridge 224 of the tray 217 and rotate the seat 260 relative to the frame 212, thereby permitting the infant to better interact with its surrounding environment and to associate the walking movements with changing its location. Alternatively, it may be desirable to place an infant in the central rotating seat assembly 215, thereby further limiting the extent to which the infant can move without totally denying him or her of the ability to exercise by rotating the seat 225 with his or her legs and/or hands. The infant can grip the inner ridge 221 or use its feet against the floor or other support surface to rotate the seat 225 relative to the frame 212.

Furthermore, the annular tray 217 serves as a table surface on which to place the infant's playthings or food. If one desires to feed the infant in either seat 260 or 225, the seats 260 and 225 may be immobilized by engaging lock mechanisms which can be provided on the annular collars 227 and 250 and on the mounting arm 241. Additionally, an infant may be placed in each of the two seats 225 and 260 at once. The walker 210 may be constructed so that one may select a setting which causes the seats 225 and 260 to turn independently or conjointly (i.e., when an infant spins the seat 260, then the seat 225 revolves about the frame, and vice versa).

The possibility that a lone infant may tip the walker 210 can be obviated by providing an annular ring 247 for connecting the lower ends 249 of the legs 216 to one another. The annular ring 247 is parallel to the tray 217 and the floor or support surface and is in contact with the floor at all points on bottom side 251. The ring 247 has attached to it a textured walkway 253 which provides traction and a clean even surface for the infant to walk on as well as serving to more evenly distribute the infant's weight.

It will be understood that the embodiments described herein are merely exemplary and that a person skilled in the art may make many variations and modifications without departing from the spirit and scope of the invention. Thus, all such variations and modifications are intended to be included within the scope of the invention as defined in the appended claims.

We claim:

1. An infant walker adapted for use in a substantially stationary location on a support surface, such as a floor, comprising a frame having a central axis and an outer circumferential edge; mounting means for mounting said frame above the support surface such that said frame is maintained in a substantially horizontal orientation with its said central axis extending vertically and such that said frame is substantially immovable relative to the support surface; supporting means, positioned adjacent to said outer circumferential edge of said frame, for supporting an infant for rotation about an axis of rotation of said supporting means, said supporting means including a seat sized and shaped so as to permit an infant to sit thereon; and suspending means for suspending said seat above the support surface such that an infant in said seat has its legs in engagement with the support surface and such that said seat is revolvable about said central axis of said frame in a circular path which circumscribes said outer circumferential edge of said frame, said suspending means including rotating means for enabling said seat to freely rotate about said axis of rotation of said supporting means, whereby an infant in said seat can walk around said frame along said circular path and/or spin about said axis of rotation.

2. The infant walker of claim 1, wherein said mounting means includes a plurality of legs depending from a lower end of a support member, said support member being attached to a bottom surface of said frame at a central position on said bottom surface.

3. The infant walker of claim 2, wherein said suspending means includes a radial member, said radial member having a first end attached to said rotating means and a second end revolvably attached to said support member, and a roller assembly attached to an upper side of said radial member between said first end thereof and said second end thereof, said roller assembly engaging with an annular track attached to said bottom surface of said frame at a position proximate to said outer edge thereof.

4. The infant walker of claim 3, wherein said rotating means includes at least one roller bearing race positioned between said radial member and said seat, whereby said rotating means maintains said seat in a horizontal orientation relative to said support surface and said seat rolls as it rotates relative to said radial member.

5. The infant walker of claim 4, wherein said frame is a circular tray including gripping means for permitting an infant in said seat to grip said tray so as to rotate said seat relative to said tray.

6. The infant walker of claim 5, wherein said gripping means includes an outer circular ridge extending upwardly from said outer circumferential edge.

7. The infant walker of claim 6, wherein said mounting means is adjustable to a desired height.

8. The infant walker of claim 1, wherein said suspending means suspends said supporting means in a cantilevered fashion above the support surface to thereby provide an unobstructed area between said supporting means an the support surface, whereby said suspending means does not inhibit engagement of an infant's legs with the support surface.

9. The infant walker of claim 8, wherein said suspending means includes a radial member rotatable about said central axis of said frame, said radial member extending from said central axis parallel to said frame and adjacent to a bottom surface of said frame.

10. The infant walker of claim 9, wherein said radial arm has a first end which is attached to a counterweight and a second end which is attached to said supporting means.

* * * * *